United States Patent [19]

Obrist

[11] 4,340,155

[45] Jul. 20, 1982

[54] TWO-COMPARTMENT PACK

[75] Inventor: Gerhard Obrist, Kaiseraugst, Switzerland

[73] Assignee: Aerosol Service AG, Möhlin, Switzerland

[21] Appl. No.: 177,640

[22] Filed: Aug. 13, 1980

[30] Foreign Application Priority Data

Aug. 24, 1979 [CH] Switzerland ..... 7701/79

[51] Int. Cl.[3] ..... B65D 83/00

[52] U.S. Cl. ..... 222/135; 222/402.1; 222/389

[58] Field of Search ..... 222/129, 135, 402.1, 222/386, 389

[56] References Cited

U.S. PATENT DOCUMENTS

| | | | |
|---|---|---|---|
| 2,956,709 | 10/1960 | Nison et al. | 222/129 |
| 3,325,056 | 6/1967 | Lewis | 222/135 X |
| 3,575,317 | 4/1971 | Prussin et al. | 222/135 |
| 3,870,147 | 3/1975 | Orth | 222/129 X |
| 3,891,125 | 6/1975 | Morane et al. | 222/129 |

*Primary Examiner*—Joseph J. Rolla

*Attorney, Agent, or Firm*—Werner W. Kleeman

[57] ABSTRACT

An inner container (11) is located within an outer container (1) which has a dispensing valve (3). The inner container itself contains an axially movable plunger (24) which in the normal position seals the internal chamber of the container from the outlet orifices (22) located at the lower end of the container. The inner container (11) is furthermore provided with a non-return valve (18) through which its internal chamber can be subjected to a compressed gas in the same way as the internal chamber of the outer container. To mix the packaged material components (A, B) which are present in the outer container (1) and in the inner container (11), the compressed gas present in the outer container is released, as a result of which the excess pressure resulting in the inner container pushes the plunger (24) downwards, so that the outlet orifices (22) are freed, and the packaged material component (B) is expelled from the inner container (11) into the outer container (1). The pack is of simple construction and easy to handle, and permits fully satisfactory mixing of the two components of the packaged material.

16 Claims, 8 Drawing Figures

TWO-COMPARTMENT PACK

Figure 1:
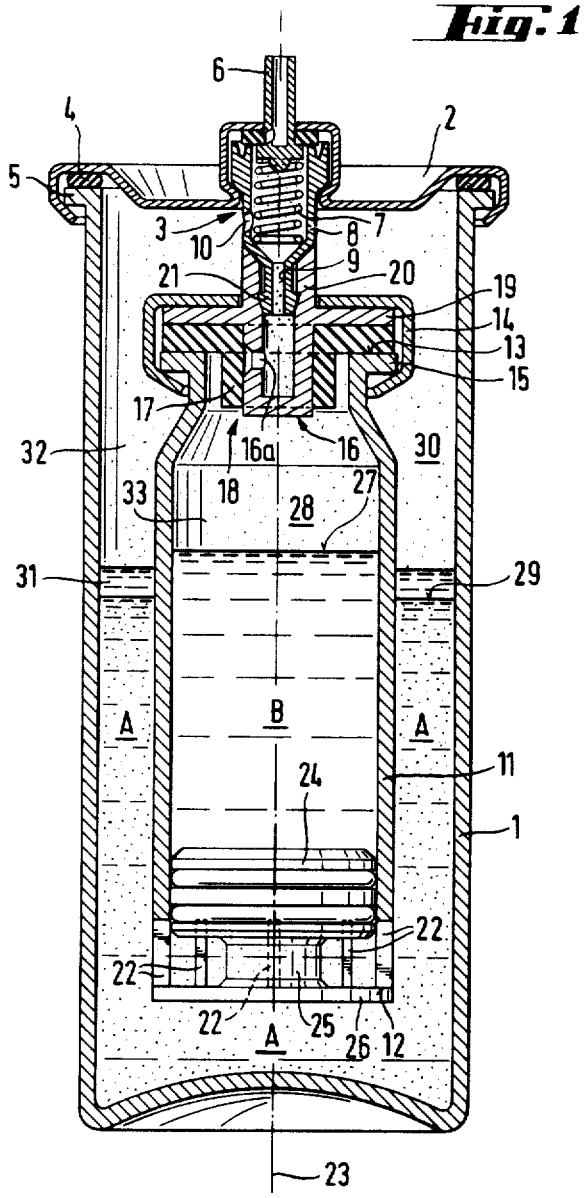

The invention relates to a two-compartment pack comprising an outer container, of substantially stable shape and provided with a dispensing valve, for a first component of the packaged material, an inner container, located in the outer container, for a second component of the packaged material, and means for mixing the two components of the packaged material and dispensing them conjointly.

Two-compartment packs of this type are employed wherever different types of packaged material have to be stored separated and must only be brought together immediately prior to their use. We shall merely mention hair dyes and the like as an example of such a case.

The essential demands made of such two-compartment packs are, on the one hand, simplicity of construction and, coupled therewith, low manufacturing costs, and, on the other hand, very simple and reliable handling, which must at the same time also ensure good mixing of the individual components of the packaged material.

Accordingly, it is the object of the invention to provide a two-compartment pack which especially conforms to these requirements.

In the text which follows, the invention is explained in more detail with the aid of the drawings. In the drawings:

FIGS. 1–6 each show an illustrative embodiment in axial section and

Figures 2, 2A, 2B:
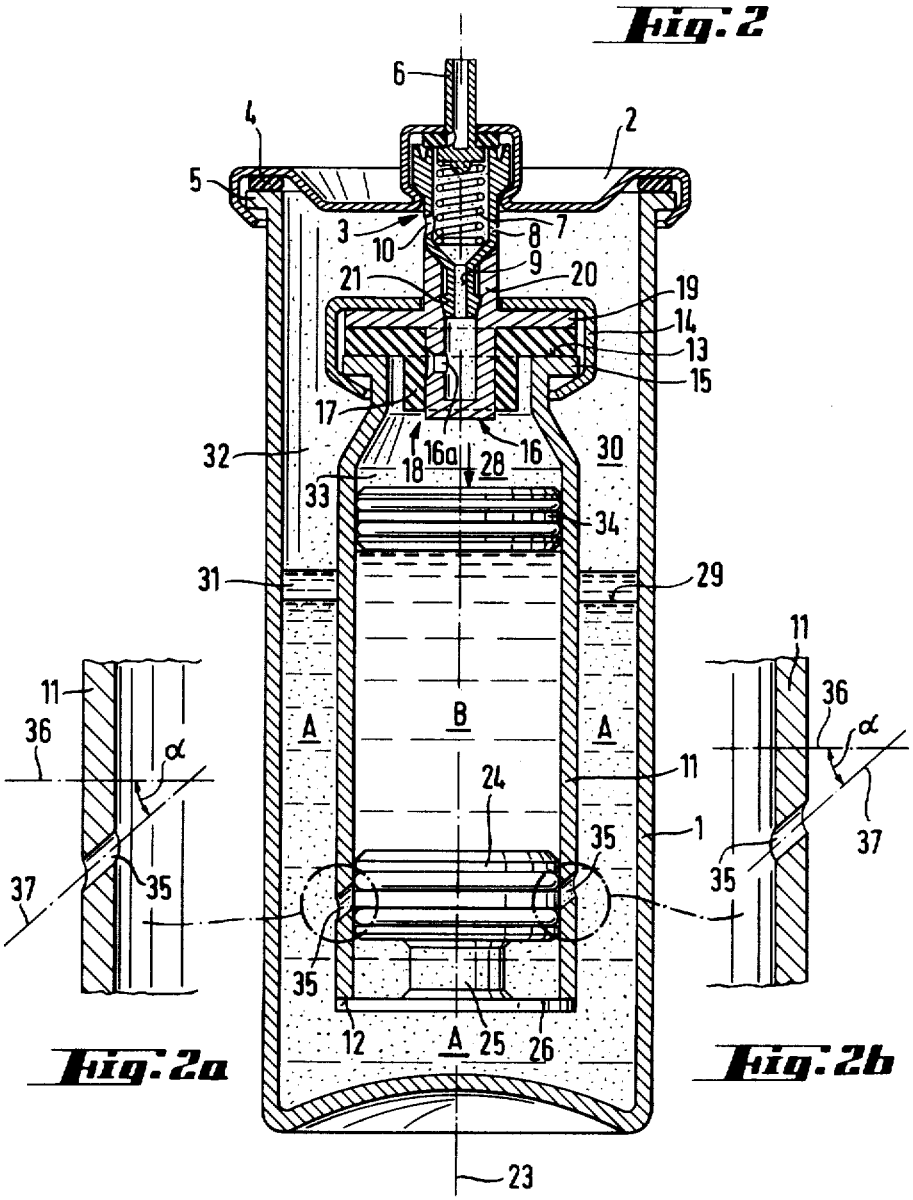

FIGS. *2a* and *2b* show two details from FIG. 2 on a larger scale.

The two-compartment pack shown in FIG. 1 comprises an outer container 1 in the form of a commercially available aerosol can having a cover 2 and a commercially available aerosol valve as the dispensing valve 3. As is usual with aerosol cans, the dispensing valve is held in the cover 2 and the latter is attached (clinched) in a leak-proof manner onto the orifice rim 5 of the container 1 with the aid of a gasket 4.

The dispensing valve 3 contains an actuation and outlet capillary 6, which can be pressed inwards into the valve housing 8 counter to a spring 7 and, when this is done, connects the internal chamber of the valve housing 8 to the external chamber of the container. The valve housing 8 is constantly in communication with the environment via an axial bore 9 and a lateral orifice 10.

In the interior of the outer container 1 there is an inner container 11 which is of substantially tubular construction and is open at its lower end 12. The upper end 13 is closed by a cover 14, a non-return valve 18, consisting of a valve body 16 possessing a radial orifice 16*a*, and a gasket tube 17, being clamped between the upper orifice rim 15 of the container and the cover 14. The valve body 16 is of substantially cylindrical construction and possesses, approximately at its middle, an outward-projecting flange 19, which rests on the orifice rim 15 via the interposed gasket tube 17 and is held there by the cover 14. Above the flange 19, the valve housing 16 forms a tubular extension 20, open at the top, which protrudes through an orifice in the cover 14 and accommodates within itself the lower, narrower part 21 of the housing 8 of the dispensing valve 3, the part 21 and the extension 20 preferably being in toothed engagement with one another or otherwise connected to one another in such a way that they cannot be released without special exertion of force.

The lower end 12 of the inner container 11 is provided with a series of outlet slits 22, running parallel to the container axis 23 and uniformly distributed over its entire periphery. The slits 22 can, as shown, extend downwards as far as the orifice rim 12 or can terminate somewhat above the orifice rim. Instead of the elongate slits, outlet orifices of different shape could also be provided.

A slidable plunger 24, which seals tightly against the container wall, is located in the interior of the container 11. The plunger is firmly connected, via a narrower plunger rod 25, to a plate 26 which, in the position of the plunger 24 as shown, rests against the orifice rim 12 of the container 11 and accordingly prevents an inward movement of the plunger 24.

The outlet slits 22 are arranged relative to the shown starting position of the plunger 24 so that there is no communication between them and the internal chamber of the container. Accordingly, in its inner starting position, the plunger 24 is partially or completely above the slits 22.

The pack is filled and assembled as follows:

First, the plunger 24 is introduced into the inner container 11 as far as the stop formed by the plate 26, and thereafter the desired component B of the packaged material is introduced into the container, the amount of the packaged material being suited to the volume of the container 11 in such a way that a free space 28 still remains above the level 27 of the packaged material. The non-return valve 18 is now placed on the container and the container is tightly closed with the cover 4. The dispensing valve 3, held in the cover 2 of the outer container 1, is now pressed into the extension 20 of the non-return valve 18 so that the cover 2, the dispensing valve 3 and the closed inner container 11 form a unit.

The other component A of the packaged material is now introduced into the outer container 1 and the entire unit including the inner container 11 is then inserted into the outer container 1, and the cover 2 is tightly fastened to the orifice rim 5 of the container 1. Here again, the amount of packaged material is suited to the volume of the container so that a free space 30 still remains above the level 29 of the packaged material.

A liquefied propellant gas 31 having a relatively high boiling point and low pressure is now introduced via the dispensing valve 3 into the pack which has, as described, been filled with the packaged material and been closed. This liquefied propellant gas passes, via the lateral orifice 10 of the dispensing valve, only into the outer container, since, due to its low pressure, it cannot overcome the barrier formed by the relatively tightly clamped gasket tube 17 of the non-return valve 18. A suitable propellant gas 31 is, for example, butane, isobutane or Freon 114®.

Nitrogen is now pressed into the pack through the dispensing valve 3, under a pressure of about 5 to 8 bar. The nitrogen—or some other gas—can pass the non-return valve 18 because of the high pressure of the gas and forms a gas cushion 32, 33, at the same pressure, above the level of the packaged material in each of the two containers 1 and 11. The outer and inner containers are in pressure equilibrium. This completes the charging of the pack, which is now ready to be sold or used.

To discharge the packaged material, the nitrogen cushion in the outer container 1 is first released, with the pack in the upright position, by actuating the dispensing valve 3. Due to the non-return valve 18, the nitrogen cannot escape from the inner container, so that a pressure difference is set up between the inner and the outer container, as a result of which the plunger 24 is abruptly pushed downwards to a point where the outlet slits 22 are in communication with the inner space of the container. The nitrogen cushion in the inner container now drives the component B of the packaged material with great force through the outlet slits 22 into the outer container 1, where it rapidly and thoroughly mixes with the other component, A, of the packaged material.

After the nitrogen cushion has thus been released and the two components of the packaged material have been mixed, the pack is inverted, so that the dispensing valve 3 is at the bottom. In this position, the dispensing valve 3 is then actuated, whereupon the propellant gas still contained in the pack forces the mixed packaged material out of the pack.

FIG. 2 shows a different embodiment of a two-compartment pack according to the invention, which conforms to even the highest requirements. Parts identical with those in FIG. 1 also bear identical references.

The most important difference compared to the embodiment according to FIG. 1 is a freely slidable second plunger 34 which is located in the inner container 11. This plunger 34 separates component B of the packaged material from the gas cushion 33 above it, so that the compatibility of the packaged material with the gas under pressure need not be taken into consideration.

On releasing the pressure cushion from the outer container 1, the compressed gas in the inner container 11 moves the plunger 34 downwards and accordingly expels the packaged material. Thereafter, the plunger 34 stops at about the level of the outlet orifices and thereby prevents the inner container from becoming filled again with the packaged material mixture.

A further difference compared to the embodiment according to FIG. 1 resides in the construction of the outlet orifices at the lower end of the inner container 11. In the present case, these are not constructed as slits but as slanting bores 35, whose axes 37 are slanted at the same angle $\alpha$, but alternately in opposite directions, to a reference plane 36 which is at right angles to the container axis 23. FIGS. 2*a* and 2*b* show this in detail. This construction and arrangement of the outlet orifices results in particularly effective mixing of the two components of the packaged material.

Figure 3:
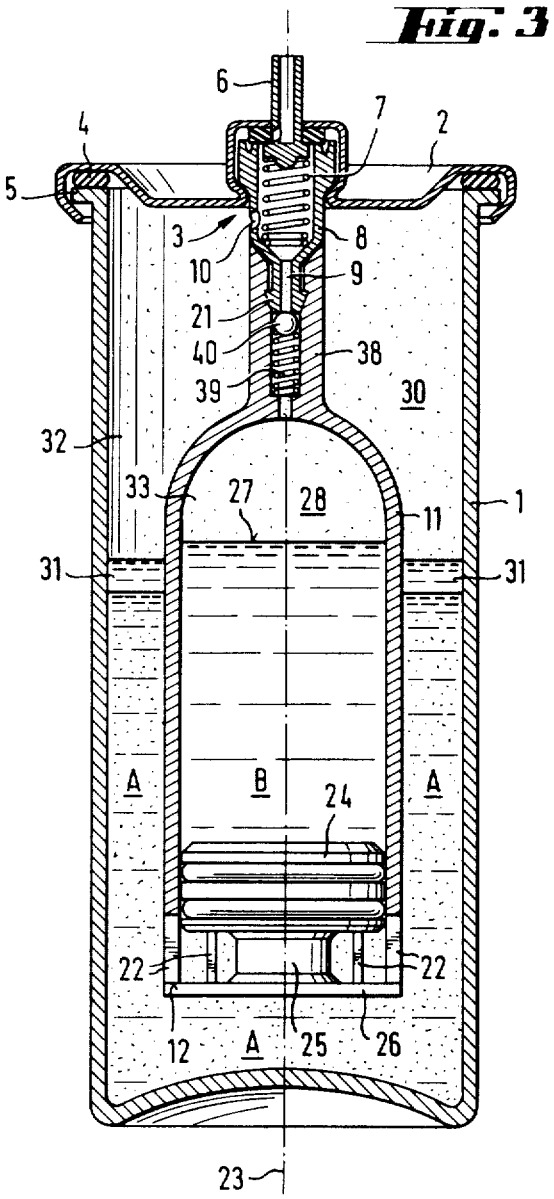
Figure 4:
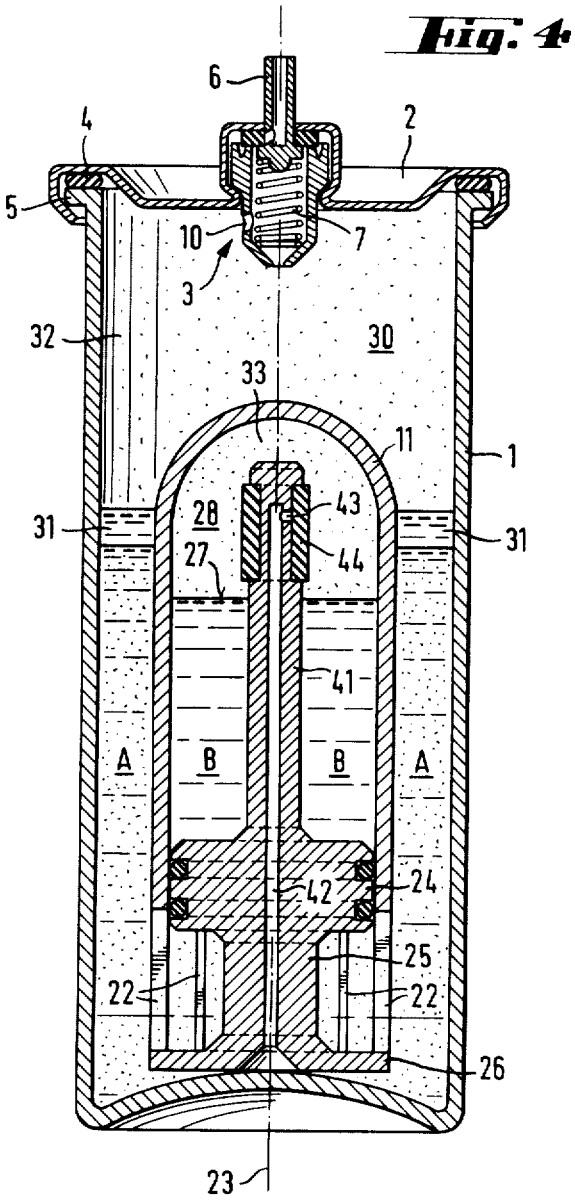

FIG. 3 shows a particularly simple embodiment of the two-compartment pack. Here again, the same parts bear the same reference as in FIG. 1.

The difference from the embodiment according to FIG. 1 is, in this case, that the inner container 11 does not have its own cover but has a one-piece bottom portion which terminates in a bottleneck-like extension 38. This extension 38 corresponds to the valve body extension 20 of FIG. 1 and is used for attaching the inner container 11 to the dispensing valve 3. At the same time, however, the extension 38 also forms the housing of the non-return valve, which in the present case is formed by a spring 39 and a valve ball 40 which is pressed by the spring against the orifice rim of the narrower part 21 of the dispensing valve 3. As has already been mentioned, this embodiment is constructionally particularly simple and therefore very cheap to produce.

Finally, FIG. 4 shows a further, again very simple, embodiment of a two-compartment pack according to the invention, in which the inner container 11 is located loosely in the outer container 1. Here again, corresponding parts bear the same reference as in FIG. 1.

The loose arrangement of the inner container 11 requires a particular construction of the plunger 24. In the present case, the plunger is provided with a one-piece riser tube 41 and possesses a continuous axial bore 42 which also extends through the plunger rod 25 and the plate 26 and opens into the outer container 1. The riser tube 41 extends into the gas space 28 above the level 27 of the packaged material and has a radial orifice 43 which is closed by a rubber tube 44 located on the outside of the riser tube. This rubber tube co-operates with the end of the riser tube to serve as a non-return valve, in the same manner as a bicycle inner tube valve.

In this illustrative embodiment, the charging of the pack with gas, that is to say the introduction of the nitrogen cushion, must take place with the dispensing valve pointing downwards. In other respects, the pack is handled in the same manner as the packs according to FIGS. 1–3.

Of course the invention is not restricted to the illustrative embodiments described above, but numerous other embodiments are possible, which all lie within the scope of the invention. In particular it is for example readily possible, in the case of the embodiment according to FIG. 4, to provide one or more additional inner containers, instead of a sole inner container, so that more than two packaged material components can be separately stored and then mixed.

The two-compartment pack according to the invention is particularly distinguished by its constructional simplicity and its simplicity of handling, but at the same time also permits particularly thorough mixing of the individual packaged material components.

Figure 5:
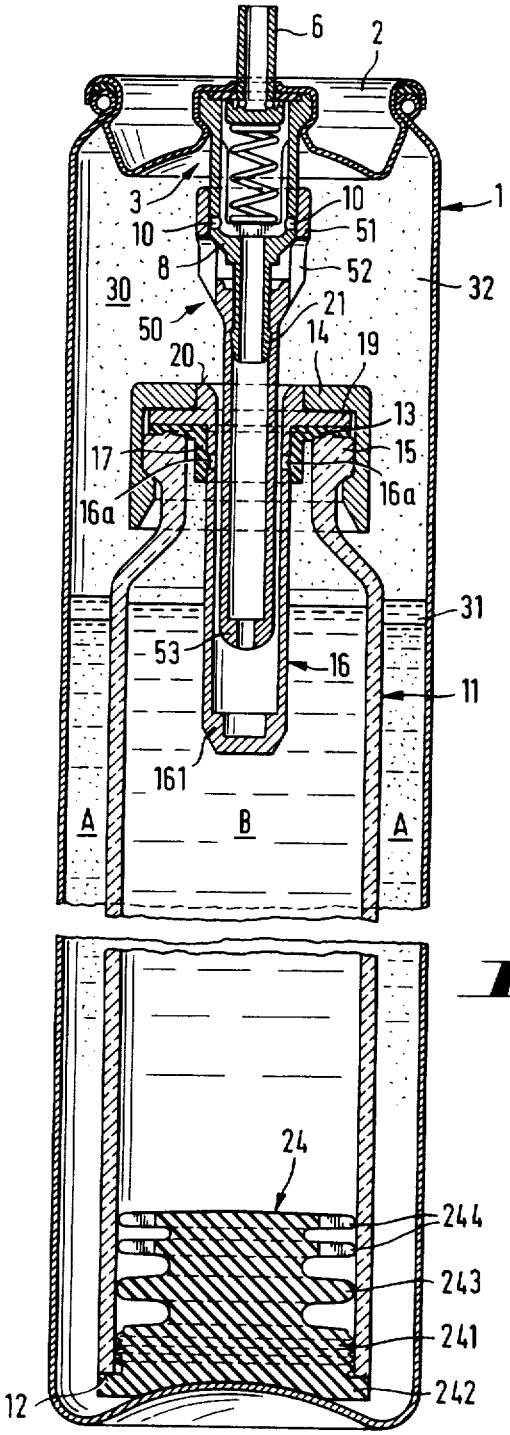
Figure 6:
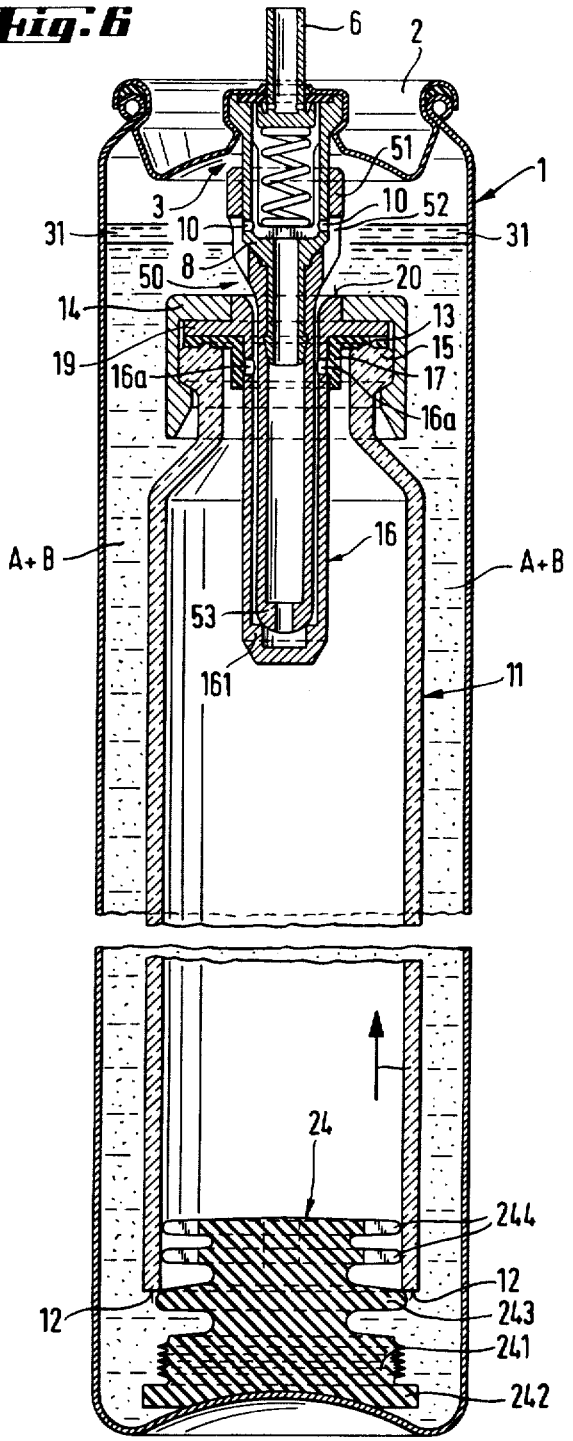

In the case of the packs described in FIGS. 1–4 it can happen, due to erroneous manipulation, for example if, when releasing the nitrogen cushion, the pack is held with the dispensing valve pointing downwards, that the packaged material component present in the outer container issues before it has mixed with the component present in the inner container. FIGS. 5 and 6 now show a further embodiment of a pack according to the invention in which this disadvantage is avoided and erroneous manipulation is impossible and/or has no adverse consequences. As was already the case in FIGS. 2–4, corresponding parts in FIGS. 5 and 6 again bear the same reference numerals as in FIG. 1.

The outer container 1, together with its cover 2 and the dispensing valve 3 held therein, is of the same construction as in FIG. 1. The inner container 11, which may for example consist of glass, possesses no lateral slits at its lower end, in contrast to the inner container in FIG. 1, and instead terminates in a continuous orifice rim 12. Accordingly, the plunger 24 is also of somewhat different construction from that in FIG. 1. It comprises a lower peripherally ribbed plug part 241, which produces the actual sealing effect, an outer stop part 242, which fits the curvature of the bottom of the outer container 1 and corresponds, in its function, to the plate 26 in FIG. 1, a sealing lip which inwardly adjoins the plug part 241, at a distance from the latter, and is itself continuous and axially somewhat resiliently deformable, and a number of guide projections 244 arranged in a star pattern.

FIG. 5 shows the plunger 24 in its inner terminal position whilst FIG. 6 shows it in its outer terminal position. In the latter, the sealing lip 243 is exactly at the level of the orifice rim 12 of the inner container 11. Due to the resilience of the lip 243 it is possible for packaged material component B to issue from the inner container but flowback of the material into the container is virtually avoided since, after the pressure has equalized, the sealing lip 243 acts virtually like a non-return valve.

Whilst this embodiment of the plunger 24 and of the lower end of the inner container 11, which differs from FIGS. 1–4, is particularly advantageous, it is not related to the constructional measures, described below, to ensure safety against erroneous manipulation, that is to say the plunger and the container could readily also be constructed according to FIGS. 1–4.

As in the illustrative embodiment according to FIG. 1, the upper end 13 of the inner container 11 is closed by a cover 14, and a non-return valve is clamped between the upper orifice rim 15 of the container and the cover 14, this valve consisting of a valve body 16 having a lateral radial valve orifice 16*a*, and a resilient membrane or gasket tube 17. The valve body 16 is constructed as a tube or cylinder which is open at the top and possesses, in the vicinity of its upper end 20, a downward-projecting flange 19 which rests on the orifice rim 15 via the interposed gasket tube 17 and is held firmly there by the cover 14. The upper end 20 of the valve body 16 protrudes through a corresponding orifice in the cover 14 and, in contrast to the embodiment according to FIG. 1, is flush with the upper surface of the cover. The part of the valve body 16 which protrudes into the inner container is somewhat longer than in FIG. 1.

In the pack according to FIG. 1, the inner container is connected, in a fixed spatial arrangement, by means of the tubular extension 20 of the valve body 16 to the narrower part 21 of the housing 8 of the dispensing valve 3. In the illustrative embodiment according to FIGS. 5 and 6, there is no such immobile connection. Instead, in this illustrative embodiment, an elongate, tubular connecting element 50 is provided, which sits, with its upper widened part 51, on the housing 8 of the dispensing valve 3. The lower, cylindrical part of the connecting element 50 protrudes loosely into the valve body 16 and forms, together with the latter, an axial guide for the container 11, along which the container can be moved up and down loosely within the outer container, between the lower position shown in FIG. 5 and the upper position shown in FIG. 6.

The widened part 51 does not sit completely immobile on the housing 8 of the dispensing valve 3, but can be moved axially, against a certain frictional resistance, from the lower position shown in FIG. 5 into the upper position shown in FIG. 6. The widened part 51 is provided with a lateral passage orifice 52 which is so arranged, in axial and circumferential respects, that in the lower position it is below the passage orifice 10 of the dispensing valve, whilst in the upper position it is at the level of this orifice 10. Accordingly, in the lower (starting) position of the connecting element 50, the passage orifice 10 is blocked, so that the inner chamber of the dispensing valve 3 is in communication with the inner chamber of the outer container 1 only via the tubular part of the connecting element 50 and the tubular valve body 16. If, on the other hand, the connecting element 50 is in its upper position (FIG. 6), the orifice 10 is free and the dispensing valve 3 communicates directly with the inner chamber of the outer container.

The lower open end 53 of the tubular connecting element 50, together with the bottom 161, constructed as a valve seat of the valve body 16, forms a valve which interrupts the communication—via the interior of the hollow connecting element 50 and via the valve body 16—between the dispensing valve 3 and the outer container 1 when the end 53 of the connecting element 50 comes into contact with the bottom 161 of the valve body 16.

The mode of operation of the pack described in FIGS. 5 and 6 is as follows.

First, the pack is assembled and filled with packaged material, propellant gas and compressed gas, as described in FIG. 1. In these operations, the connecting element 50 assumes its lower position—shown in FIG. 5—relative to the dispensing valve 3.

To mix the two components A and B of the packaged material, the dispensing valve 3 is now actuated with the pack held upright (FIG. 5) and the compressed gas cushion present above the packaged material component A in the outer container is released. The compressed gas escapes via the valve body 16, the connecting element 50 and the dispensing valve 3. Due to the resulting pressure disequilibrium between the inner and the outer container the plunger 24 is brought—as is also the case in the other illustrative embodiments—from its inner terminal position into its outer terminal position, shown in FIG. 6, and at the same time the packaged material component B present in the inner container 11 is expelled from the said container.

The plunger 24 rests, with its stop part 242, against the bottom of the outer container. Hence, as this plunger moves from the inner to the outer terminal position, the inner container 11 is rapidly pushed upwards. During this upwards movement of the container 11, the lower end 53 of the connecting element 50 makes contact with the bottom 161 of the valve body 16 and now also pushes the connecting element 50 upwards until it occupies its upper position relative to the dispensing valve 3, in which position—as described above—the passage orifice 10 of the dispensing valve 3 is free. On further actuation of the dispensing valve 3, the mixture of the two packaged material components A and B, present in the outer container, then issues—precisely as described in FIG. 1—through the orifice 10 and via the dispensing valve 3, as a result of the action of the propellant gas.

If, erroneously, an attempt is made to release the pressure cushion, not with the pack held upright as in FIG. 5, but, for example, with the dispensing valve 3 pointing downward, the inner container 11 moves downward, that is to say in the direction of the dispensing valve 3, under its own weight, as a result of which movement the lower end 53 of the connecting element 50 comes into contact with the bottom 161 of the valve body 16 and thereby interrupts communication between the inner chamber of the outer container and the dispensing valve, so that the packaged material cannot issue through the dispensing valve 3. Accordingly, it is only possible to release the pressure cushion if the pack is in the correct, upright position.

I claim:

1. A two-compartment pack comprising an outer container, of substantially stable shape and provided with a dispensing valve, for a first component of the package material, an inner container, located in the outer container, for a second component of the package material, and means for mixing the two components of the package material and dispensing them conjointly, wherein the inner container is elongate and is open at one end, a plunger which can slide sealingly between two terminal positions is located in the inner container and in its inner terminal position, more remote from the open end of the inner container, separates said open end from the internal chamber of said inner container and in its outer terminal position, closer to said open end, opens a passage orifice between the internal chamber of the inner container and the internal chamber of the outer container, said inner container has a gas inlet which communicates with the internal chamber of the outer container and comprises a non-return valve which leads into the internal chamber of the inner container, which internal chamber is sealed by the plunger in its inner terminal position, and the outer and the inner container each contain a cushion of a gas under superatmospheric pressure.

2. A pack according to claim 1, wherein the plunger possesses a circumferential resilient sealing lip which, in the outer terminal position of the plunger, rests resiliently against the open end of the inner container and at least partially prevents packaged material from flowing back into the inner container.

3. A pack according to claim 1, wherein the end opposite the open end of the inner container is closed by a tubular, outwardly open valve body which protrudes coaxially into the inner container and comprises at least one lateral valve orifice closed by a resilient membrane between the internal chamber of the valve body and the internal chamber of the inner container, said valve body forming, together with said resilient membrane, the non-return valve, and an open tubular connecting element, is attached to and communicates with the dispensing valve, which communicating element protrudes into the tubular valve body and forms an axial guide for the inner container, along which guide the inner container is freely movable to and fro, in an axial direction, up to a position where the open end of the connecting element makes contact with the bottom of the valve body.

4. A pack according to claim 3, wherein the internal chamber of the dispensing valve is in communication, via the tubular connecting element and the outwardly open valve body, with the internal chamber of the outer container the open end of the connecting element forms, together with the bottom of the valve body, a valve which, when the open end rests on the bottom, breaks the said communication between the dispensing valve and the internal chamber of the outer container.

5. A pack according to claim 3 or 4, wherein the connecting element is attached to the connecting valve in such a manner that the connecting element can be moved from a first to a second position against a frictional force, and that the first position a lateral communication orifice of the dispensing valve between the internal chamber of the valve and the internal chamber of the outer container is closed, whilst in the second position this orifice is open.

6. A pack according to claim 5, wherein the plunger in the inner container partially protrudes, at least in its outer terminal position, from the open end of the inner container, and, on moving from the inner to the outer terminal position, causes a movement of the inner container towards the dispensing valve, and the lengths of the outer container, the inner container, the valve body and the connecting element are matched to one another in such a way that, when the plunger moves from its inner to its outer terminal position, the inner container is first moved until the open end of the connecting element rests against the bottom of the valve body and then is moved, together with the connecting element, until the connecting element reaches its second position, in which the lateral communication orifice of the dispensing valve is open.

7. A pack according to claim 1, wherein the inner container comprises at least one lateral outlet orifice in the vicinity of its open end, which orifice is separated from the internal chamber of the inner container when the plunger is in its inner terminal position, and communicates with the internal chamber of the inner container when the plunger is in its outer terminal position.

8. A pack according to claim 7, wherein the outlet orifice is formed by a slit in the inner container wall, substantially parallel to the axis at said inner container wall.

9. A pack according to claims 7 or 8, wherein the inner container comprises a plurality of outlet orifices which are substantially uniformly distributed over its periphery.

10. A pack according to claim 7, wherein the inner container is provided with several outlet orifices distributed along its periphery, which orifices are of nozzle-shaped construction, with their longitudinal axes or jet directions being inclined alternately to one and the other side relative to a plane which is at right angles to the longitudinal axis of the inner container.

11. A pack according to claim 1 wherein the plunger includes a stop plate (12) which sits on the rim (12) of the open end of the inner container and thereby limits the inward movement of the plunger.

12. A pack according to claim 1, wherein the inner container is arranged so as to be substantially freely movable in the outer container and the plunger includes a riser tube which extends substantially up to the end of the inner container opposite to the plunger, the plunger having a through-bore which connects the riser tube to the outer container, and a gas inlet, with a non-return valve, being attached to the end of the riser tube.

13. A pack according to claim 12, wherein a second plunger is arranged so as to be freely movable in the inner container, and the space enclosed between the two plungers serves to receive the second component of the packaged material and the space enclosed by the second plunger and the inner container wall, and facing away from the first plunger, contains the compressed gas cushion.

14. A pack according to claim 1, wherein the inner container is attached to the dispensing valve by the end of the inner container which is opposite the open end.

15. A pack according to claim 14, wherein the inner container has a neck-shaped extension which contains the non-return valve and is connected to the dispensing valve.

16. A pack according to claim 14, wherein the non-return valve is inserted in the inner container and has a tubular extension which is connected to the dispensing valve.

* * * * *